US005112258A

United States Patent [19]

Folsom

[11] Patent Number: 5,112,258

[45] Date of Patent: May 12, 1992

[54] APPARATUS FOR RAISING AND LOWERING A TROLLING MOTOR

[76] Inventor: Richard R. Folsom, 2223 W. 10th St., Irving, Tex. 75060

[21] Appl. No.: 635,990

[22] Filed: Dec. 31, 1990

[51] Int. Cl.[5] ..... B63H 21/26

[52] U.S. Cl. ..... 440/63; 440/6

[58] Field of Search ..... 440/6, 7, 1, 62, 49, 440/53, 63, 900; 248/637, 642

[56] References Cited

U.S. PATENT DOCUMENTS

| | | | |
|---|---|---|---|
| 3,881,443 | 5/1975 | Hamp | 440/6 |
| 3,930,461 | 1/1976 | Brock | 440/7 |
| 3,948,204 | 4/1976 | Brock | 440/6 |
| 3,965,844 | 6/1976 | Brock | 440/6 |
| 3,980,039 | 9/1976 | Henning | 440/6 |
| 4,668,195 | 5/1987 | Smith | 440/6 |
| 4,708,670 | 11/1987 | Peters | 440/6 |
| 4,734,066 | 3/1988 | Burgess | 440/6 |

*Primary Examiner*—Joseph F. Peters, Jr.
*Assistant Examiner*—Clifford T. Bartz
*Attorney, Agent, or Firm*—Paul M. Denk

[57] ABSTRACT

Apparatus (10) for use with a trolling motor (M) on a fishing boat (B) to raise and lower the motor. A frame (12) is attachable to the boat, and a movable bracket (18) has one end fixedly attached to the motor and its other end rotatably connected to the frame. A lever (34) is connected to the motor to move the motor between its two position. A reversible electric motor (44) drives a gear mechanism (46) to move the lever in one direction when the motor is lowered and in the opposite direction when the motor is raised.

19 Claims, 2 Drawing Sheets

APPARATUS FOR RAISING AND LOWERING A TROLLING MOTOR

BACKGROUND OF THE INVENTION

This invention relates to low speed motors mounted on a bass boat or the like, and used by fishermen to troll the boat while they fish, and more particularly, to an apparatus for raising and lowering such a motor so it can be lowered into the water when the fisherman wants to fish at a desired location in a lake or other waterway and raised during the time the fisherman is going to and returning from the location.

Many fishermen fish from boats which are typically driven from a boat dock or other launch site to a desired fishing spot by an outboard motor which is usually a large horsepower motor. At the site, which may be the shallow water along the bank of a stream, the backwater of a tributary, or the inlet of a lake, a fisherman may want to move slowly about the area while he fishes. For this purpose, the boat may come equipped with, or the fisherman may attach, a small horsepower outboard motor called a trolling motor This is a motor designed to move the boat at slow speeds but with sufficient power to push it through brush, reeds, or other shoreline growth. While such a motor may be permanently mounted on the boat so its propeller is underwater, this is not especially desirable because the motor produces a pronounced drag on the boat when it is being driven by the larger horsepower motor. Consequently, many trolling motors are removably installed on a mount so the fisherman can install the motor when he reaches his chosen site and remove it when he gets ready to leave. While not heavy, installing and removing a trolling motor does take time, and can be difficult to do on windy days or in choppy water. Compounding this problem is the fact many trolling motors are mounted on the front end of a boat (this being because the larger horsepower motor is mounted on the back end). If the boat is a "bass" type boat, or flat boat, this may make no appreciable difference because that end of the boat is easy to get at. If, however, the boat is one of those having a steering means in its aft section, a cowling or hood covering its forward section, and a windshield separating the two sections, installation of the trolling motor becomes much more difficult. Now, someone must carry the motor over the hood (which usually does not have hand holds or foot holds), and install and remove it, all the while making sure he, or the motor, do not fall overboard.

Attempts have been previously made to address this problem of trolling motor installation. Devices, such as hoisting apparatus, to which a trolling motor is permanently attached so it can be more readily raised and lowered have been developed. Most of these devices, though, while providing means for pivotal movement of the trolling motor with respect to its permanently mounted base between a horizontal disposition of storage atop the forward end of the boat, or as along its railing at a back edge, or being pivoted into vertical disposition downwardly into the water, for application and usage, have been devised Normally, these type of means for manipulation of a trolling motor are manually operated, and have a rope, cable, or the like attached to the trolling motor, and which is pulled by the fisherman, for manipulating the trolling motor between its in water disposition, or out of the same as when not in usage. In some instances, electrically powered hoists have been used to aid the fisherman in raising and lowering of the trolling motor more quickly. For example, the U.S. Pat. No. 3,965,844, to Brock, shows an apparatus for pivotally mounting of a fishing motor. But, this particular device incorporates a series of cable segments for achieving a motivation of the trolling motor, as supported by the box-like means as shown, for shifting the trolling motor between its operative and inoperative positions. The device includes its mounting frame, a drive wheel, a bracket carried by the mounting frame, and cable means to render it operative. These types of means, in the form of cable, are just not incorporated into the current invention.

The U.S. Pat. No. 3,980,039, to Henning, is also upon an electrically operated bow mount for a trolling motor. This device incorporates a trolling motor that can be shifted between its vertical position, to it horizontal inoperative position, and such is achieved through the usage of a single supporting mounting bracket, that mounts by means of a support plate to the deck of the boat. Motivation for the device is achieved through the reversible motor, as shown, controlled remotely, which apparently actuates a gearing arrangement that partially turns a gear, and provides for a raising and pivoting of the motor tube, through the agency of its integral elongated gear rack, as associated therewith.

The U.S. Pat. No. 3,930,461, is also upon an apparatus for pivotally mounting an outboard fishing motor to a boat. It discloses a trolling motor, that is supported on a bracket, and the bracket is mechanically turned by a cable arrangement, as can be seen, between its non-use position, as shown horizontally and located upon the boat, but which may be pivoted into a vertical disposition, as shown in hidden line, when arranged in an operative position. There is a reversible electric motor that is interconnected within the structure of this device, for achieving the pivot of the trolling motor, through its bracket, about the guide member as disclosed. This particular device is of a rather complex structure, and requires the usage of an arcuately curved guide member within its structure, in order to achieve its functioning.

Another U.S. Pat. No. 3,948,204, to Brock, is also upon an apparatus for pivotally mounting an outboard motor, onto a fishing boat. But, once again, this apparatus still incorporates the use of cable means, and a drive wheel combination, for achieving a shifting of the trolling motor between its inoperative position, as generally shown in its drawings, and into its vertical disposition, when operating, as shown in solid line within this patent. It defines an elongated mounting frame, adapted to be fixed to the boat, and includes a slide block that mounts for slidable linear movement along the full length of the mounting frame. Such structure is not incorporated into the embodiment of this current invention.

SUMMARY OF THE INVENTION

Among the several objects of the present invention may be noted the provision of apparatus for lowering a trolling motor into the water from the side of a boat, so a fisherman can move slowly about an area while fishing, and for raising the motor out of the water when the boat is to be moved to another spot or returned to its dock; the provision of such apparatus to be electrically operable by a switch located on a control console of the boat or other convenient location near the fisherman;

the provision of such apparatus to which the trolling motor is readily attached and which holds a trolling motor in a proper position while it propels the boat through shallow water, brush, moss, and other vegetation; the provision of such apparatus which is easy to install and which fits any boat and trolling motor; the provision of such apparatus which securely holds the trolling motor in place during travel to and from a fishing location, but which also allows the motor to be lowered and raised while the boat is being moved by another power source; the provision of such apparatus to produce no harmonics or other destructive vibrations which may damage the boat or trolling motor;-and, the provision of such apparatus which allows the fisherman to make additional casts of his fishing because he does no longer has to manually unstow, lower, raise, and restow his trolling motor.

In accordance with the invention, generally stated, apparatus is provided for use with a trolling motor on a fishing boat. The apparatus is used to lower the motor into the water so it can slowly move the boat about while fishing takes place, and to raise the motor to a storage position when it is not in use so the boat can be moved by an alternate power source. The apparatus comprises a frame attachable to the boat, and a movable bracket one end of which is fixedly attached to the trolling motor and the other end of which is rotatably connected to the frame. A lever is connected to the trolling motor to lower and raise it. A reversible electric motor moves the lever in one direction when the motor is lowered into the water and in the opposite direction when the motor is raised to its storage position.

As can be readily understood, the apparatus for raising and lowering a trolling motor, of this design, can be mounted at various locations upon its supporting boat. For example, as shown in FIG. 1, housing for the gearing is disclosed as being mounted along the right front side of the deck, but the trolling motor could be just as easily mounted for usage at a position along the upper front left of the deck, by simply reversing the position of the apparatus housing, to the other side, and attaching it to its motor frame, as can be seen. In that condition, one simply flips over the entire apparatus, repositions its housing, for operations in a similar manner to that which is described herein.

In addition, this device can be used with a variety of types of trolling motors For example, one of the trolling motors normally used by the fisherman is of the type that is operated by a foot control, and includes a single shaft that extends down through its bracket, as known in the art. This particular device is operated remotely by means of a motor mechanism that is located in the motor, but can be adapted for use in combination with the lifting apparatus of this invention. On the other hand, another type of control that is used to support a trolling motor is that as shown in this current invention, and this particular type is of the manual or hand operated form of trolling motor, and is not really constructed for operation for use in conjunction with any type of foot control. There is actually a third type of trolling motor that is used in fishing, and this type of device is operated by a foot control that is arranged rather proximate to the trolling motor, and such a trolling motor incorporates a pair of telescoping shafts, with the upper shaft connecting to the upper motor, and with the bottom shaft being the one that turns the trolling motor itself in response to functioning of a foot control. This current invention likewise can be used in combination with this third type of trolling motor, by attachment of its pivotal frame means to the upper shaft of these telescoping means incorporated within the type of trolling motor described Other objects and features will be in part apparent and in part pointed hereinafter, particularly when reviewed in combination with the description of the preferred embodiment hereinafter set forth.

BRIEF DESCRIPTION OF THE DRAWINGS

Corresponding reference characters indicate corresponding parts throughout the drawings.

DESCRIPTION OF A PREFERRED EMBODIMENT

Figure 1:
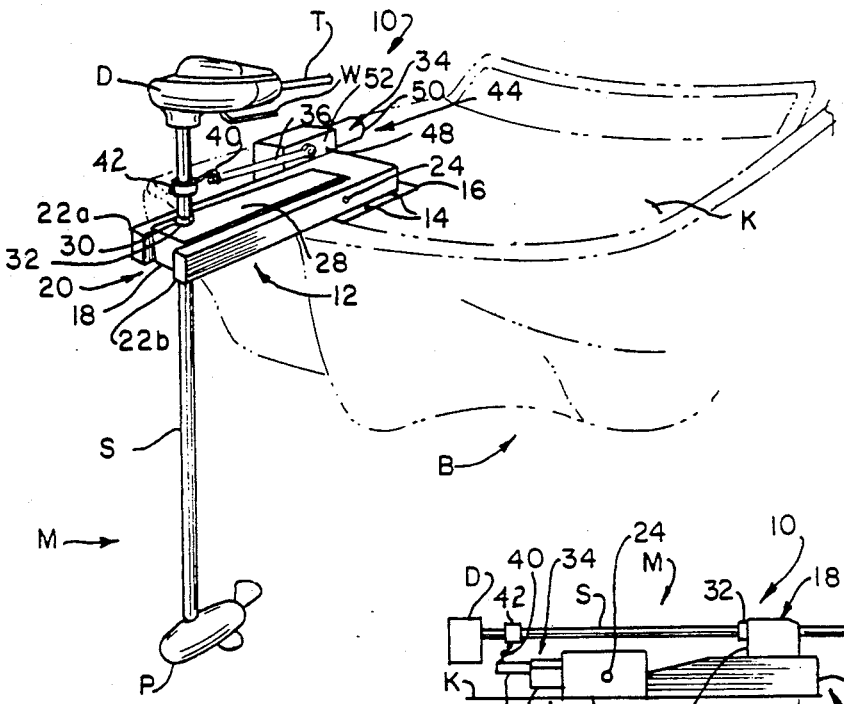
FIG. 1 is a perspective view of the apparatus of the present invention installed on the bow of a boat and for use with a trolling motor.

Referring to the drawings, apparatus 10 of the present invention is generally shown in FIG. 1. The apparatus is for use with a trolling motor M, a low horsepower, electrically powered motor, which is installed on a fishing boat B. The motor has an elongate shaft S which is hollow. A drive assembly D is located at one end of the shaft (the upper end when the motor is lowered into the water), and a propeller section P is attached to the other end of the shaft. Electrical wires W connect the motor to a battery B through a switch 11 (see FIG. 3). The switch may be located on a dashboard of the boat or other convenient location. A tiller T may be connected to the drive section of the motor to rotate the motor's orientation (particularly, the position of the propellers) to change the direction of movement of the boat). As will be described hereinafter, apparatus 10 functions to lower motor M into the water W (see FIG. 2*b*), so the trolling motor, when running, can slowly move the boat about while fishing takes place. Using the trolling motor allows the boat to move through shallow waters either alongside a bank or in inlets, through places not readily accessible because of reeds, submerged trees or other growth, as well as hold the boat's position against a current. All of these features give a fisherman wider freedom in choosing where to fish. The apparatus also functions to raise the trolling motor out of the water to a storage position (see FIG. 2*a*) so the boat can be driven to and from a dock or launch site by, for example, a high horsepower outboard motor or other alternate power source.

Figure 2A:
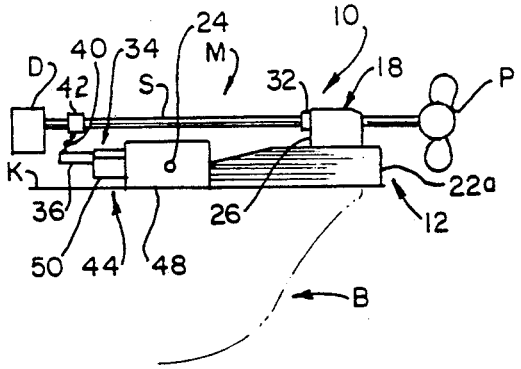
FIGS. 2*a* and 2*b* are side elevational views of the apparatus with the trolling motor in its respective raised and lowered positions.
Figure 2B:
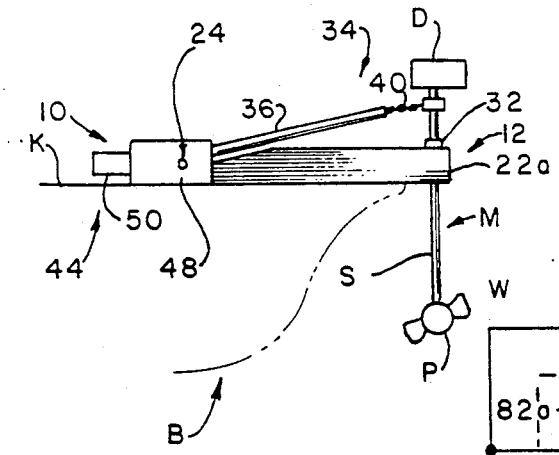

Apparatus 10 includes a frame 12 installable on the boat. As shown in FIGS. 1, 2*a*, and 2*b*, the frame is fastened to the deck K of the boat adjacent its front end, or bow. It will be appreciated, however, that frame 10 is also attachable to the rear or sides of the boat. The frame may be attached in any convenient manner, for example, by screws 14. As seen in FIG. 1, the frame is generally U-shaped in plan with the open ended portion of the frame projection outward past the side or end of the boat. A flange 16 is formed about the rear or closed end of the frame and rests upon the top of the deck. The flange has spaced openings along each side for the screws 14.

A movable bracket 18 is sized to fit in the elongate opening 20 between side members 22*a*, 22*b* of the frame. The bracket is pivotally connected to the frame by a pin 24 which extends between the side members and through the side walls 26 of the bracket. The length of the bracket substantially corresponds to the length of opening 20 and pin 24 extends through the sidewalls of bracket 18 adjacent the inner end of the bracket. The bracket also has a top wall 28. An opening 30 is formed in the outer end of this top wall and is sized for shaft S of motor M to fit into the opening. The position of the shaft is adjusted, for example, to insure that the position of the propellers is now lower than the keel of the boat; this, so the propellers will not strike the bottom and damage the motor. Once the shaft position is set, it can be locked in place using a locking clamp 32 or other suitable appliance.

A lever 34 comprises a lever arm 36. One end of the lever arm is pivotally connected to a shaft 38 (see FIG. 4). The other end of the arm is connected to shaft S of the trolling motor by a spring 40. The spring is relatively stiff, but also sufficiently flexible so as to cushion the trolling motor against shock and vibrations occurring during its movement by the apparatus. One end of the spring is connected to the outer end of lever arm 36; while, the other end of the spring is attached to a collar 42 fitting about shaft S adjacent the upper end of the shaft (as viewed in FIGS. 1 and 2*b*).

Figure 4:
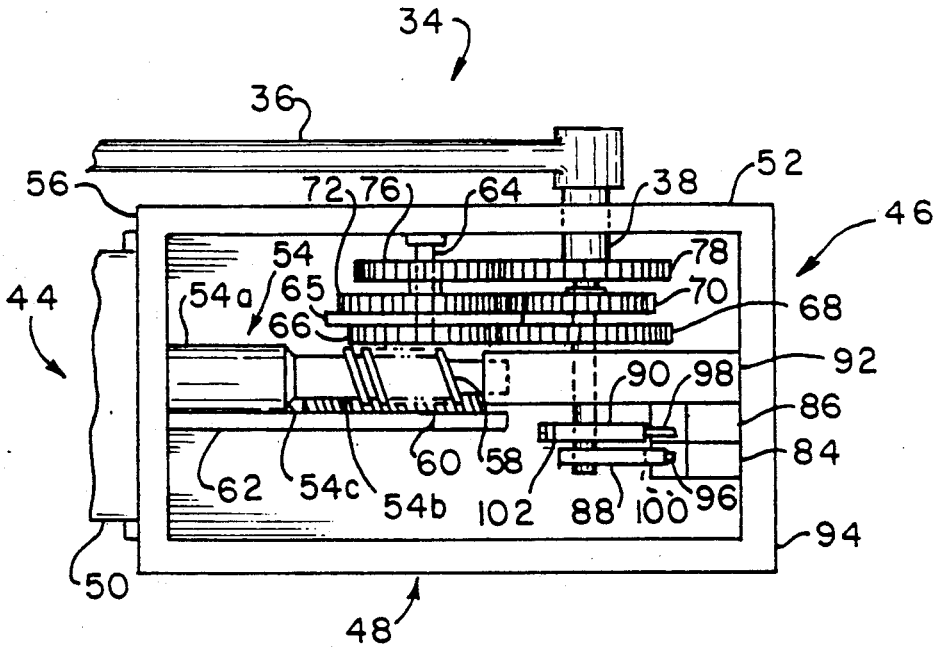
FIG. 4 is a top plan view of a gear mechanism for the apparatus.

Lever 34 is driven in the appropriate direction to move lever 34 by means of a reversible electric motor 44 and gear mechanism 46. The gear mechanism is enclosed in a housing 48 which is positioned rearwardly of frame 12 and to the side thereof for connection of shaft 38 to lever 34. This housing is attachable to the deck of the boat in the same manner as the frame. Motor 44 has a housing 50 attachable to a rear endwall of housing 48. Referring to FIG. 4, shaft 38 extends through a sidewall 52 of housing 48, and motor 44 has an output shaft 54 extending inwardly into the housing through an endwall 56 of the housing. Shaft 54 has a first diameter section 54*a*, an outer, smaller diameter section 54*b*, and an intermediate, transition section 54*c*.

A worm gear 58 is formed on section 54*b* at the outer end of the shaft. The teeth of gear 58 mesh with those of a second worm second worm gear 60. A wall 62 extends forwardly of housing 48 from end wall 56, wall 62 being parallel to and displaced to one side of shaft 54. Gear 60 is mounted for rotation at one end of a shaft 64. This end of the shaft is mounted on wall 62, and the other end of the shaft mounts on sidewall 52 as disposed on the opposite side of shaft 54. Shaft 64 extends orthogonally of, and beneath shaft 54, and gear 60 is thus positioned to one side, the outboard side, of shaft 54.

A spur gear 66 is interconnected with gear 60 so rotation of gear 60 causes rotation of gear 66. Gear 66 is commonly mounted on shaft 64 with gear 60 and may even be integrally formed with gear 60. As shown in FIG. 4, gear 66 is located on the opposite side of shaft 54 from gear 60. The teeth of gear 66 intermesh with a second spur gear 68 which is installed on shaft 38. Shaft 38 extends parallel to shaft 64 and gear 68 rotates freely on this shaft; i.e., rotation of gear 68 does not produce rotation of shaft 38. A gear 70, also a spur gear, is interconnected with gear 68 so rotation of gear 68 causes rotation of gear 70. Gear 70 is also freely mounted for rotation on shaft 38. As with gears 60 and 66, gears 68 and 70 may be integrally formed. Gear 70 intermeshes with a spur gear 72 which is mounted on a shaft 64. One end of shaft 64 seats in sidewall 52 of housing 48; while the other end of the shaft seats in interior wall 62 of the housing, as aforesaid. A spur gear 76 is interconnected with gear 72 for rotation of gear 72 to cause rotation of gear 76. Gear 76 is likewise freely mounted for rotation on shaft 64. Gears 68 and may be integrally formed. Lastly, gear 76 intermeshes with a gear 78 that is rotatably mounted on shaft 38 for movement of the gear to rotate the shaft and consequently lever 34.

The size and number of teeth of the various gears comprising mechanism 46 are as follows:

| Gear number | diameter (in.) | teeth |
|---|---|---|
| 50 | 2.50 | 50 |
| 66 | 1.00 | 16 |
| 68 | 2.25 | 44 |
| 70 | 1.00 | 16 |
| 72 | 2.25 | 44 |
| 76 | 1.00 | 16 |
| 78 | 2.25 | 44 |

This combination of gears produces a gear ratio of approximately 525:1.

Figure 3:
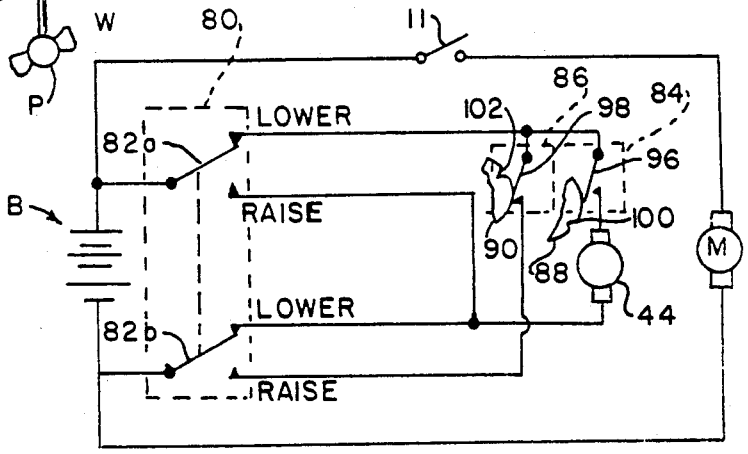
FIG. 3 is a schematic of the electrical circuit for the apparatus.

From the foregoing it will be understood that rotation of motor 44 in one direction will serve, via gear mechanism 46, lever 34, and bracket 18, to lower the trolling motor into the water; while rotation in the opposite direction will serve to raise it. As shown in FIG. 3, current to motor 44 is supplied through a switch 80 which is located on a dashboard or control panel for the boat, or in any other convenient location. Power lines L1 and L2 from battery B are routed to motor 44 through switch 80. Switch 80 has a pair of ganged switch arms 82, 82*b* each movable between a trolling motor "lower" or "raise" position. Switching between these positions reverses the connections between the battery and motor 44 so the motor runs in the appropriate direction. To precent the motor from running after the trolling motor has been lowered or raised to its maximum extent, a pair of limit switches 84, 86 (see FIGS. 3 and 4) are installed in the respective "lower" and "raise" circuit paths. Each limit switch has an associated cam 88, 90 respectively. As shown in FIG. 4, an interior wall 92 projects rearwardly from front wall 94 of housing 48. The outer end of shaft 54 is supported in the rear face of wall 92, and shaft 38 extends through the wall. Gears 68, 70, and 78 are positioned on shaft 38 on one side of wall 92, and cams 88, 90 are mounted on shaft 38 on the other side of the wall. Limit switches 84, 86 are mounted on front end wall 94 and each switch has a contact arm 96, 98 respectively, against which a cam face of the respective cams bear As shown in FIG. 4, the limit switches are mounted side-by-side on the end wall and cams 88, 90 are thus arranged in a side-by-side parallel relationship on shaft 38.

Each cam face urges its respective switch arm into a switch closed position. However, at the opposite ends of the respective cam faces is a notch (100, 102 respectively) extending transversely of the cam face. When the trolling motor reaches the respective end of its downward or upward travel, the notch in the-respective cam face allows the switch arm for the appropriate limit switch to move to a switch "open" position. This stops current flow to motor 44 and terminates the lowering or raising of the trolling motor. However, the other limit switch is still in its "closed" position, so moving switch 80 to its other position will allow current flow to motor 44 to move motor M in the opposite direction.

Figure 5:
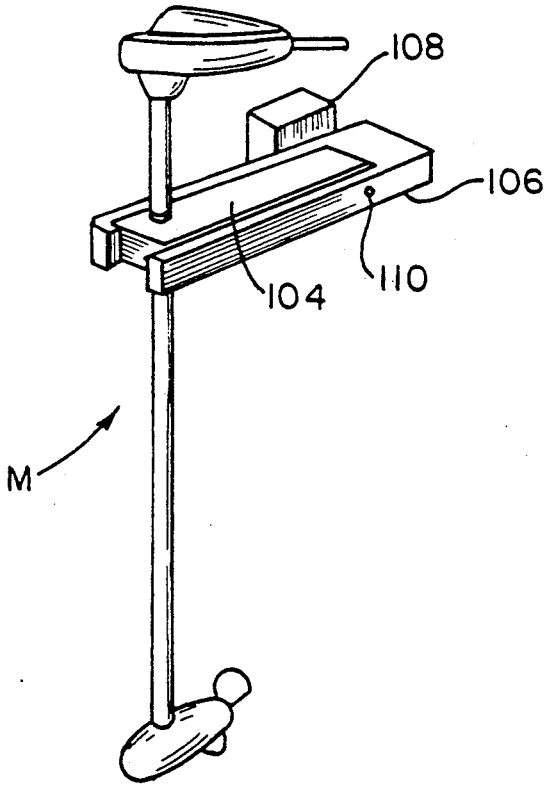
FIG. 5 is an isometric view of a simplified form of trolling motor pivot means incorporating the subject matter of this invention.

FIG. 5 discloses the trolling M being mounted to a movable bracket 104, that is disposed pivotally within its supporting frame 106. A motor means 108, of the type as previously described, is used for affecting a turning of its connected and extending shaft 110, to provide a direct pivot to the bracket 104, for shifting the trolling motor between its vertically disposed operating position, within the water, as shown in FIG. 5, or to a more horizontally disposed position, as when not in use, equivalent to what is shown in FIG. 2*a*. This type of simplified means discloses how a lever arm, being pivotal as result of motor action, could be used to directly provide for the disposition of the trolling motor down in the water, or pivoted to a non-operating position, as may desired..

What has been described has been an easy to install, simple to use apparatus which works will all types of boats and all types of trolling motors. The apparatus allows a fisherman to quickly lower a trolling motor into the water when a fishing site is reached, and raise it out of the way when fishing is over. The apparatus is of a sturdy metal construction which readily withstands the buffeting which often occurs on windy days. The apparatus is further designed to not allow the motor to overdrive the gear mechanism by which the trolling motor is lowered and raised so the apparatus is not inadvertently jammed.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed as desired to be served by Letters Patent is:

1. Apparatus for use with a trolling motor on a fishing boat to lower the motor into the water so it can slowly move the boat about while fishing takes place and to raise the motor to a storage position when not in use for movement of the boat by an alternate power source, comprising:

frame means attached to the boat;

movable bracket means one end of which fixedly attached to the motor and the other end of which is rotatably connected to the frame means;

reversible electric motor means connected with the frame means, gear means interconnected with the motor means and providing for speed reduction in the operations of the motor means, lever means connected to the gear means for moving the trolling motor between its lowered and raised positions, one end of the lever means being directly connected to the gear means, while the opposite end of the lever means connected to the trolling motor, and the gear means being driven by the motor means to move the lever means, whereby moving the lever means in one direction lowers the trolling motor into the water, and in the opposite direction when the trolling motor is raised to its storage position.

2. The apparatus of claim 1 wherein the frame means includes a housing for the gear means, the motor means also being mounted on the housing means for an output shaft of the motor to interface with the gear means to drive it in the appropriate direction to lower and raise the motor.

3. The apparatus of claim 1 wherein the gear means includes a plurality of intermeshing gears acting as a gear reducer between the motor means and lever means.

4. The apparatus of claim 3 wherein the gear reduction ratio is approximately 525:1.

5. The apparatus of claim 1 further including switch means controlling operation of the motor means and actuable by the gear means.

6. The apparatus of claim 5 wherein the switch means includes a limit switch connected in a power line between the motor means and a power source therefore, and the gear means includes cam means operating on the switch to maintain power to the motor means while the trolling motor is being moved between its lowered and raised positions, but to interrupt power to the motor means when the trolling motor reaches its lowered or raised position.

7. The apparatus of claim 6 wherein the gear means includes a rotatable shaft on which the cam means is mounted and the switch means includes a switch arm contacted by the cam means.

8. The apparatus of claim 7 wherein the cam means comprises a pair of cams mounted adjacent each other on the shaft, each cam having a cam surface bearing against the switch arm to maintain the switch closed during movement of the trolling motor between its end positions, each cam surface having a notch therein corresponding to the respective end position of trolling motor movement the notch allowing movement of the switch arm to open the switch and interrupt power to the motor means to stop further driving of the trolling motor in that direction.

9. The apparatus of claim 6 wherein the motor means includes an output shaft having a gear formed on the outer end thereof and the gear means includes a second gear intermeshing with the first said gear.

10. The apparatus of claim 9 wherein the gear means further includes a third gear connected to the second gear and turning therewith.

11. The apparatus of claim 10 wherein said third gear intermeshes with a fourth gear which, in turn, is connected to a fifth gear and turns therewith.

12. The apparatus of claim 11 wherein said fifth gear intermeshes with a sixth gear which, in turn, is connected to a seventh gear and turns therewith, the seventh gear intermeshing with an eighth gear that is mounted on a shaft connected to the lever means.

13. The apparatus of claim 12 wherein the gear on the output shaft of the motor means and the second gear are worm gears and the other gears are spur gears.

14. Apparatus for use with a trolling motor on a fishing boat to lower the motor into the water so it can slowly move the boat about while fishing takes place and to raise the trolling motor to a storage position when not in use for movement of the boat by an alternate power source, comprising:

frame means attached to the boat;

movable bracket means one end of which fixedly attached to the motor and the other end of which is rotatably connected to the frame means;

lever means connected to the trolling motor for moving the trolling motor between its lowered and raised positions;

reversible electric motor means for moving the lever means in one direction when the trolling motor is lowered into the water and in the opposite direction when the trolling motor is raised to its storage position;

gear means interposed between the motor means and lever means, one end of the lever means being connected to the gear means and the gear means being driven by the motor means to move the lever means;

the trolling motor having a drive section at one end, a propeller section at its other end, and a shaft connecting the two sections, the lever means including a lever arm one end of which is connected to the gear means and the other end of which is connected to the trolling motor shaft by a spring means.

15. The apparatus of claim 14 wherein the spring means includes a spring having one end connected to the lever arm and the other end attached to the trolling motor shaft.

16. The apparatus of claim 15 further including a clamp about the trolling motor shaft to which the other end of the spring is connected.

17. The apparatus of claim 14 wherein the bracket means is attached to the trolling motor shaft to support the trolling motor during its movement.

18. Apparatus for use with a trolling motor on a fishing boat to lower the motor into the water so it can slowly move the boat about while fishing takes place, and to raise the trolling motor to a storage position when not in use for movement of the boat by an alternate power source, comprising:

frame means attached to the boat;

movable bracket means one end of which is pivotally attached to the frame means, and the other end of which connects to the trolling motor, rigid lever means, and reversible electric motor means for directly moving the lever means in one direction when the trolling motor is lowered into the water, and in the opposite direction when the trolling motor is raised to its storage position.

19. The invention of claim 18 and including spring means interconnecting between the lever means and the trolling motor to cushion the movement of the trolling motor during its shifting between its water disposed and storage positions.

* * * * *